US012789957B2

(12) United States Patent
Rositch et al.

(10) Patent No.: US 12,789,957 B2
(45) Date of Patent: Nov. 10, 2026

(54) RESTRAINT DEVICE FOR WATERCRAFT LIFTS

(71) Applicants: Aaron J. Rositch, Port Charlotte, FL (US); Mike A. Scharpf, Oshkosh, WI (US)

(72) Inventors: Aaron J. Rositch, Port Charlotte, FL (US); Mike A. Scharpf, Oshkosh, WI (US)

( * ) Notice: Subject to any disclaimer, the term of this patent is extended or adjusted under 35 U.S.C. 154(b) by 172 days.

(21) Appl. No.: 18/148,556

(22) Filed: Dec. 30, 2022

(65) Prior Publication Data

US 2024/0217631 A1 Jul. 4, 2024

(51) Int. Cl.
*B63C 3/06* (2006.01)

(52) U.S. Cl.
CPC ..... *B63C 3/06* (2013.01)

(58) Field of Classification Search
CPC ..... B63C 3/06
USPC ..... 405/3
See application file for complete search history.

(56) References Cited

U.S. PATENT DOCUMENTS 3,177,668 A * 4/1965 Schneider ..... B63C 3/06 52/651.05
4,195,948 A * 4/1980 Vancil ..... B63C 3/06 405/3
7,547,159 B1 * 6/2009 Warters ..... B63C 3/06 70/57
7,856,936 B2 * 12/2010 Nemethy ..... B66F 7/02 405/3

* cited by examiner

*Primary Examiner* — Sean D Andrish

(57) ABSTRACT

A plurality of devices that are permanently attached to a watercraft lift device that are used to create a temporary, yet secure, connection between the bunk system of a watercraft lift and the lift support pilings to prevent the bunk system and watercraft from moving excessively during wind events. The devices consist of a piling bracket that is permanently attached to each corner piling, a lift cradle attachment assembly that clamps onto the lift cradle I-beam, and a length of chain which is permanently attached to the lift cradle attachment assembly and can be selectively engaged with the piling bracket to create a temporary connection to restrain motion of the lift cradle.

2 Claims, 5 Drawing Sheets

RESTRAINT DEVICE FOR WATERCRAFT LIFTS

BACKGROUND

A watercraft lift device is used to lift a watercraft out of a body of water during periods of non-use and/or storage. This is typically done to prevent damage to the vessel that can occur when wind or waves on the body of water may cause the vessel to make unwanted contact with a dock or wharf structure as may happen when the vessel is tied to such structure, to prevent excessive water infiltration into the vessel as might happen when the vessel is floating in a body of water and wind and wave action overcome the deck height of a vessel, to prevent the vessel from being damaged due to contact with the bottom of the body of water due to wave action, tides or wind driven water phenomena, and to prevent the growth of marine life on the water contacting portions of the vessel. These watercraft lift devices typically consist of a cable lift system that are connected to the upper end of pilings driven into the seafloor or attached to some other support structure that provides sufficient distance between the cable lift system and the surface of the water that a bunk system with a watercraft resting on it can be raised far enough out of the water to prevent the described damaging events, and can be lowered far enough into the water to allow the watercraft to float off of the bunk structure. The bunk system typically consists of a front and rear horizontal lifting beam that span the width of the vessels, and two or more bunks that run longitudinally with, make contact with, and support the hull of the vessel. While these types of watercraft lifts control the vertical position of the bunk system and watercraft, they typically provide very little resistance to motion in a plane that is perpendicular to vertical lift direction.

While the watercraft lift device can prevent the types of damage listed, it exposes the watercraft to wind events that may cause the lift bunk system and the watercraft resting on this bunk system to move relatively unconstrained in a horizontal plane, potentially making contact with dock and wharf structures, structures and parts of the watercraft lift device not intended to make contact with the bunk structure or watercraft, ancillary equipment mounted to the dock, wharf, or watercraft lift, or adjacent equipment, vessels, pilings, docks or wharfs, or other structures in the vicinity.

SUMMARY

One implementation of the present disclosure is a plurality of devices that are intended to be permanently attached to each corner of a typical four, six or eight-post watercraft lift device, according to an exemplary embodiment, and can act as restraint devices to prevent unwanted motion of a watercraft lift bunk system when a temporary connection is made between the watercraft lift bunk system attachment structure and the piling attachment bracket components utilizing the securing chain. The disclosed devices consist of an attachment plate, a clamping plate, connecting hardware between the attachment plate and clamping plate, a securing chain, securing chain retaining hardware, a piling connection bracket, and piling connection bracket attachment hardware. When the watercraft is sitting on the watercraft lift bunk structure in times of storage or non-use and lifted out of the water, the disclosed devices can be used to quickly secure each corner of the bunk system to the corner pilings, preventing unwanted motion of the bunk system and watercraft, and preventing damage to watercraft, bunk system, corner or other pilings, other watercraft lift structures or equipment, adjacent docks, wharfs, structures, vessels, or equipment. Additionally, the disclosed devices provide a secure attachment point to restrain the watercraft to the bunk system with ancillary tie down devices during high wind events.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
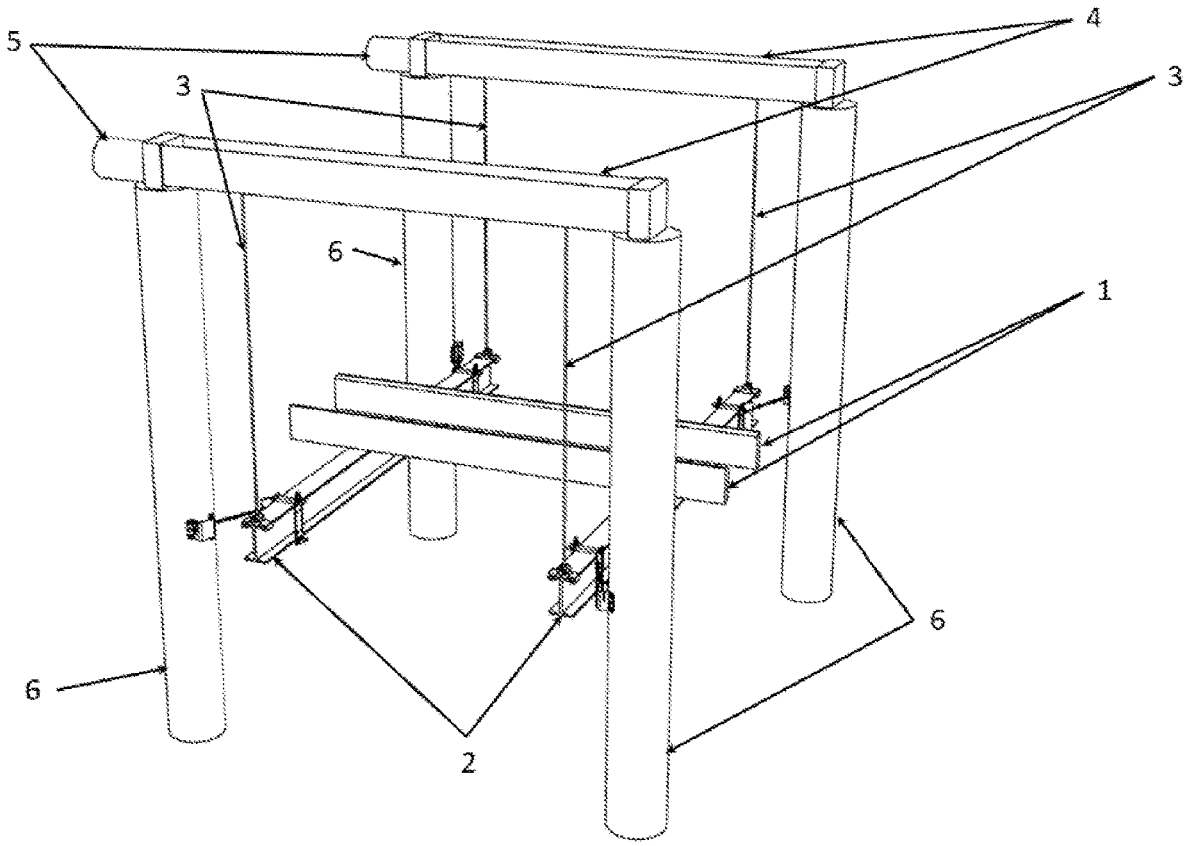
FIG. 1 depicts a typical four-post watercraft lift devices in which the disclosed devices can be seen on each of the four corners in order to show the relative positioning of the devices in the preferred embodiment described within.
Figure 2:
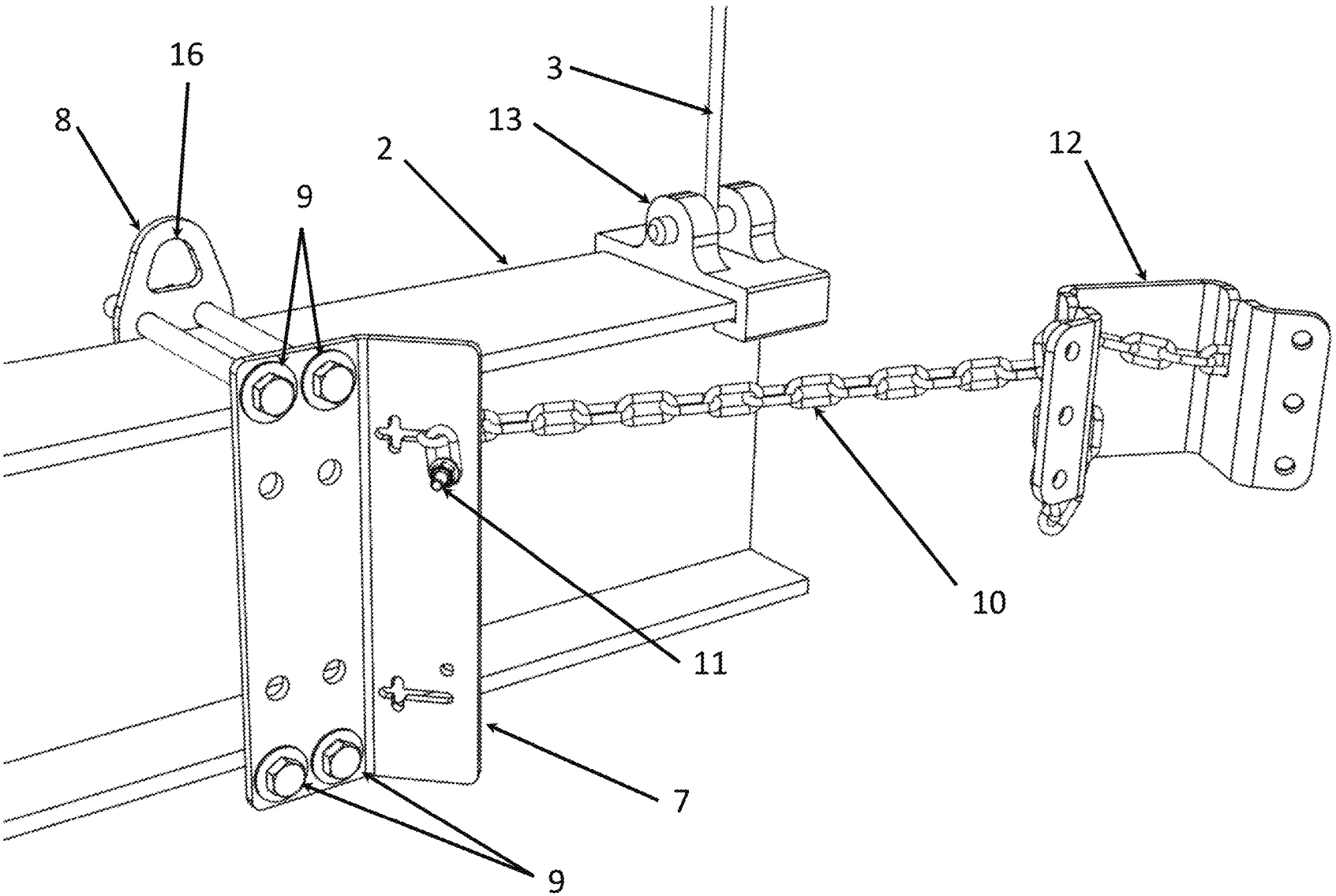
FIG. 2 illustrates a detailed view of one of the disclosed devices on one corner of the four-post watercraft lift.
Figure 3:
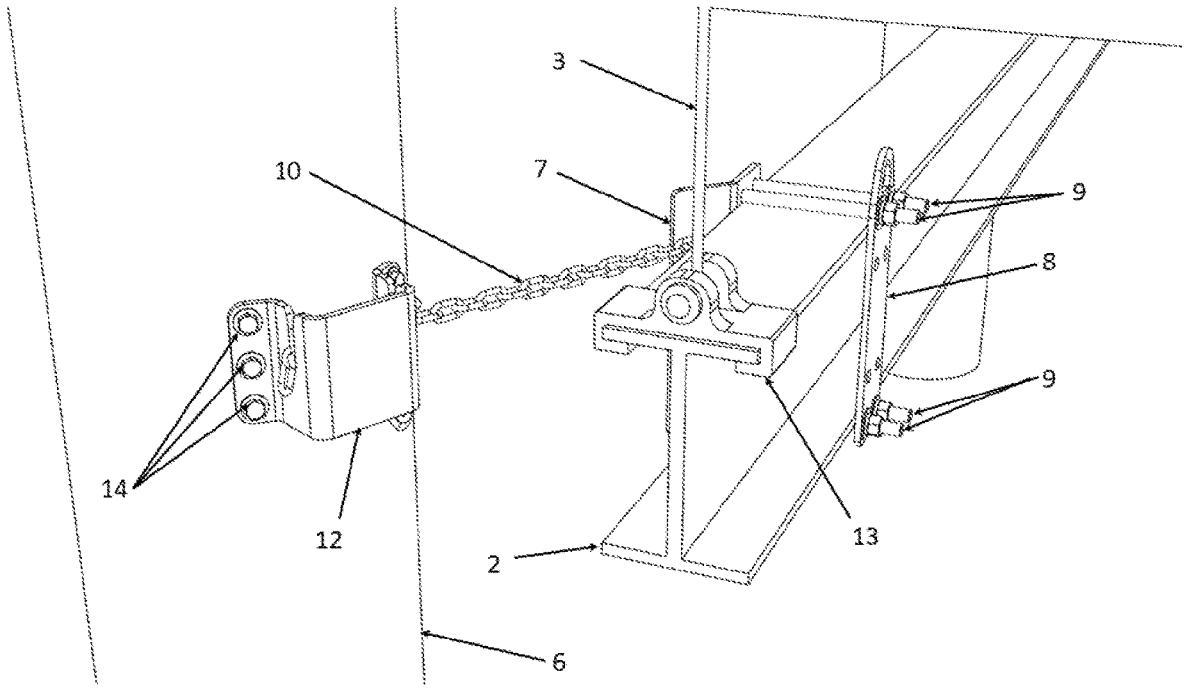
FIG. 3 show an alternate view of the disclosed device such that relative positioning of the I-beam to the support piling can be more clearly shown.

One implementation of the present disclosure is a group of devices that are attached to each corner of a typical four-post watercraft lift device, according to an exemplary embodiment. A typical four-post cable actuated watercraft lift device is shown in FIG. 1. The bunks (1) are connected to the I-beam (2), which are supported by cables (3) that are wrapped around the cable wrapping drum and structure (4). The cable wrapping drum and structure (4) can be rotated by the electric rotary actuator (5), creating a vertical motion of the bunk system, comprised of the bunks (1), I-beams (2), and ancillary attachment points and structural hardware not shown in the figure. The cable wrapping drum and structures are affixed to the upper end of the corner pilings (6). In FIG. 2, the disclosed devices consist of an attachment plate (7), a clamping plate (8), connecting hardware (9) between the attachment plate (7) and clamping plate (8), a securing chain (10), securing chain retaining hardware (11), a piling connection bracket (12), and piling connection bracket attachment hardware (FIG. 3, 14). Also in FIG. 3, the ancillary attachment point of the bunk system (13) can be seen attached to an I-beam (2) in a typical manner.

Figure 4A:
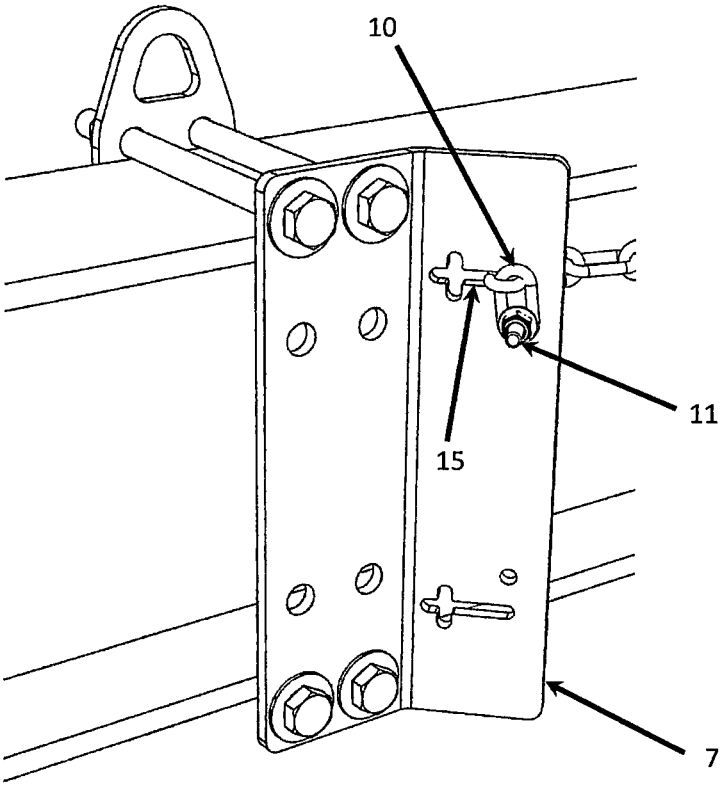
FIG. 4A illustrates detail of the securing chain locked into the attachment bracket securing slot.
Figure 4B:
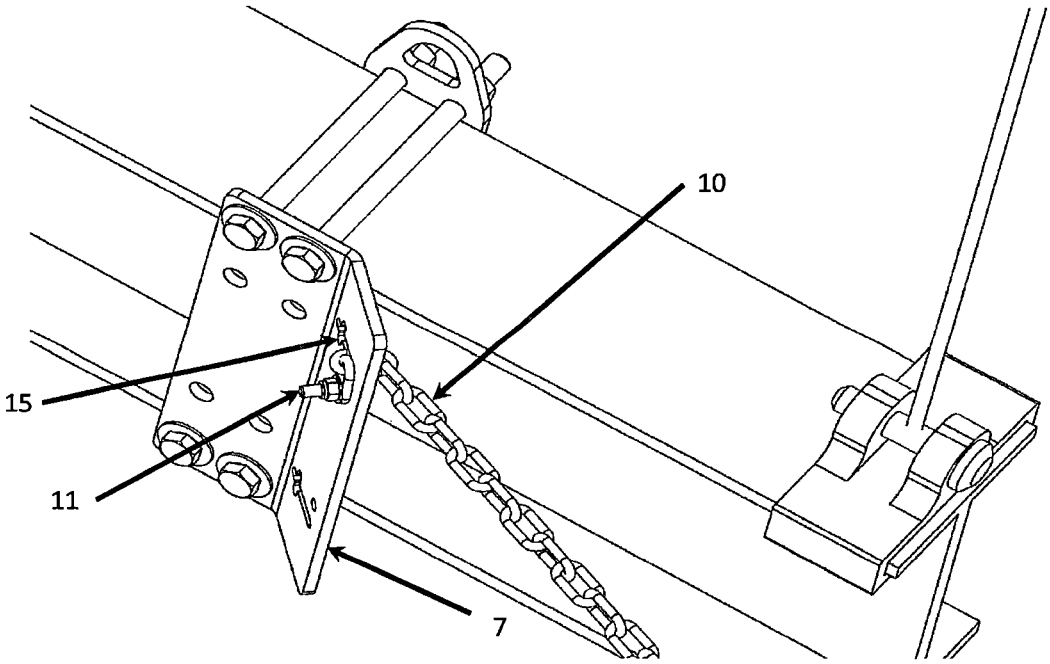
FIG. 4B offers an additional view of how the securing chain is locked into the attachment bracket securing slot and then retained in place by the securing chain retaining hardware.

The disclosed devices consist of an attachment plate (FIG. 2, 7) and a clamp plate (8) that are connected by a group of standard bolted connections (9) and are positioned around the I-beam (2) of the watercraft lift bunk structure and clamped into position. The attachment plate (7) provides a slot provision (FIG. 4A, 15) for attachment of a securing chain (10), as well as a provision for the securing chain retaining hardware (11). The securing chain (10) in the preferred embodiment is attached by sliding the chain through a slot provision (15) in the attachment plate (7) such that the load in the chain acts directly on structure of the attachment plate through a link of the chain. The end of the securing chain (10) that is on the side of the slot opposite of the direction of the securing load is then connected to the attachment plate (7) with the securing chain retaining hardware (11). The securing chain retaining hardware (11) is not meant to take any of the load that is generated through the securing chain during wind events, but rather to ensure the securing chain (10) is retained in the attachment plate (7) during all operating conditions. The manner in which the securing chain (FIG. 4B, 10) is positioned in the slot provision (FIG. 4B, 15) of the attachment plate (FIG. 4B, 7) is shown at an alternate angle to provide clarity in how the these two components interact. This bolted together structure with the securing chain attached is referred to as the attachment structure. In the preferred embodiment shown in the figures, the attachment structure position on the I-beam can be adjusted at initial installation of the devices to minimize the amount of slack present in the securing chains when all of the securing chains are attached to the piling attachment brackets to limit the horizontal motion of the bunk structure. There are other embodiments of attaching the securing chain (10) to the I-beam (2) which could include cutting slots or drilling holes in the I-beams, welding mounting provisions onto the I-beams, or bolting provisions onto the I-beams. The clamping plate (8) in this exemplary embodiment includes a provision for connecting a tie down device (FIG. 2, 16) that can be optionally used to restrain the watercraft to the bunk system. There is a separate attachment structure clamped on to each corner of the four-post watercraft lift bunk system, typically with one attachment structure on each end of the bunk system front I-beam and one attachment structure on each end of the bunk system rear I-beam. The attachment structure is meant to stay attached to the bunk system during times of storage or non-use, while the lift is operating, and when the bunk system is lowered into to the water such that the watercraft can be launched or retrieved. In addition to the attachment structures secured to the bunk structure, a pilling connection bracket will be attached to each of the four corner pilings nearest the front or rear I-beam attachment structures. In the exemplary embodiment each piling connection bracket is permanently secured to the support piling, typically a wooded pole, with lag screws. The piling connection bracket (FIG. 2, 12) provides slots which the securing chain (10) will be slid into in order to temporarily secure the watercraft lift bunk structure during times of storage or non-use. The piling attachment bracket (12) is meant to stay attached to the piling system during time of storage or non-use, while the lift is operating, and when the bunk system is lowered into to the water such that the watercraft can be launched or retrieved.

In addition to the attachment structures secured to the bunk structure, a pilling connection bracket will be attached to each of the four corner pilings nearest the front or rear I-beam attachment structures. In the exemplary embodiment each piling connection bracket is permanently secured to the support piling, typically a wooded pole, with lag screws. The piling connection bracket (FIG. 2, 12) provides slots which the securing chain (10) will be slid into in order to temporarily secure the watercraft lift bunk structure during times of storage or non-use. The piling attachment bracket (12) is meant to stay attached to the piling system during time of storage or non-use, while the lift is operating, and when the bunk system is lowered into to the water such that the watercraft can be launched or retrieved.

Figure 5:
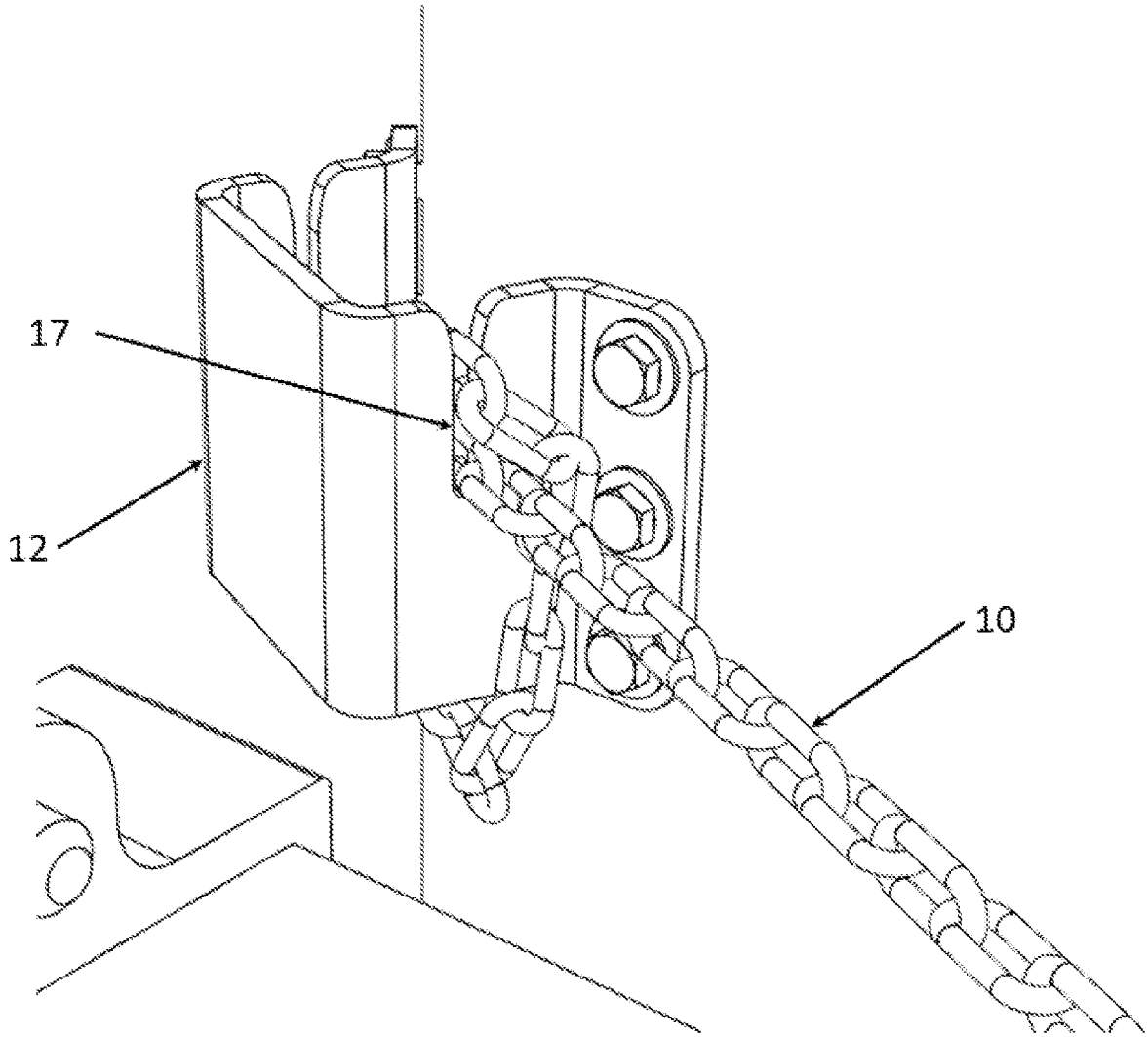
FIG. 5 illustrates the preferred embodiment the method in which the securing chain is locked into the piling attachment bracket.

During periods of storage or non-use, the securing chain (10), which is permanently attached to the attachment structure, can be manually positioned such that a link can slide into the retaining slot (FIG. 5, 17) on the piling connection bracket (12), thereby creating a physical connection between the bunk system and the corner pilings that limits the movement of the bunk system and watercraft resting upon it. By sliding the securing chain (10) through a slot (17) in the piling attachment bracket (12), securing loads generated during wind events are directly transmitted into the piling attachment bracket structure. By securing all four corners with the disclosed devices in a manner that allows securing loads to be generated in all directions of the horizontal plane, the watercraft lift bunk structure and the watercraft resting upon it, will be restrained from excessive motion that might allow it to move during wind events and contact adjacent structures, equipment, vessels, etc., potentially causing damage to these other objects, as well as the vessel and bunk structure. The preferred embodiment of the piling attachment bracket (12) will have multiple slots that are long enough to encompass the width of two links of chain, thereby creating a simple chain locking mechanism as the chain is wrapped around the piling attachment bracket and slid into the slot in a way the overlaps the initial chain connection in the piling attachment bracket, or overlaps a chain connection in a second slot in the bracket (FIG. 5) The preferred embodiment will contain sufficient lengths of chain at each of the four corners of the lift such that it can be wrapped around the piling attachment bracket and locked into place as shown in FIG. 5. It should be noted that there are multiple embodiments of methods to wrap the chain and lock it into position which are not shown in the figures. One or both of the slots (17) on the piling attachment bracket (12) may be used for this purpose in other embodiments.

In a third embodiment of this present disclosure, tensioning devices may be added at one or more restraining device positions to remove any inherent slack in the securing chains that a user may find objectionable. These tensioning devices may act directly on links of the chain, may act between the links of chain the piling attachment bracket, or may act between links of chain and the attachment structure. Typical examples of tensioning devices are, but not limited to, chain binders, turnbuckles, ratchet straps, and clamps.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the terms "exemplary" and "example" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent, etc.) or moveable (e.g., removable, releasable, etc.). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," "between," etc.) are merely used to describe the orientation of various elements in the figures. It should be noted that the orientation of various elements may differ according to other exemplary embodiments, and that such variations are intended to be encompassed by the present disclosure.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

It is important to note that the construction and arrangement of the systems as shown in the exemplary embodiments is illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the components described herein may be constructed from any of a wide variety of materials that provide sufficient strength or durability, in any of a wide variety of colors, textures, and combinations. Accordingly, all such modifications are intended to be included within the scope of the present inventions. Other substitutions, modifications, changes, and omissions may be made in the design, operating conditions, and arrangement of the preferred and other exemplary embodiments without departing from scope of the present disclosure or from the spirit of the appended claims.

The invention claimed is:

1. A lifting bunk restraint system for cable operated boat lifts comprising:

a plurality of securing chains comprised of a plurality of links, a plurality of attachment assemblies, each attachment assembly is comprised of:

a. an attachment plate having a slot that is wider than a diameter of a wire, but narrower than a width of a link of a chain that creates all links of one of the plurality of securing chains, and at least as long as the width of the link of one of the plurality of securing chains, that any of the links of one of the plurality of securing chains can be to be inserted into in order to create a connection between the attachment plate and the respective securing chain that such that an adjacent link of the respective securing chain cannot be pulled through the plate, to create a permanent connection that is positioned vertically and on a side of a horizontal lifting I-beam that is part of a lifting bunk structure of a cable operated boat lift b. a clamping plate that is positioned vertically and on an opposite side of the horizontal lifting I-beam that is part of the lifting bunk structure of the cable operated boat lift from the attachment plate c. a set of clamping hardware connecting the attachment plate to the clamping plate which can span a width of the horizontal lifting I-beam that is part of the lifting bunk structure of the cable operated boat lift and allows an attachment assembly position on the I-beam to be adjusted d. securing chain retaining hardware that provides retention of the respective securing chain in the slot of the attachment plate when the respective securing chain is not under load at least one of the plurality of attachment assemblies is attached to each corner of the lifting bunk structure of the cable operated boat lift, the lifting bunk structure which is comprised of:

a. a plurality of horizontal lifting I-beams b. a plurality of horizontal boat bunks that are arranged approximately perpendicular to the horizontal lifting I-beams c. a plurality of hardware and brackets that are used to connect the horizontal lifting I-beams to the horizontal boat bunks a plurality of chain engagement brackets that are permanently attached to vertical support pilings at all four corners of the cable operated boat lift and are respective to the plurality of attachment assemblies and securing chains, each of the plurality of chain engagement brackets which contains a slot that is wider than the diameter of the wire, but narrower than the width of the link of the chain that creates a plurality of all links of the plurality of securing chains, and at least as long as the width of the link of the plurality of securing chains, that any of the plurality of links of the securing chain can be to be inserted into in order to create a connection between the respective chain engagement bracket and the respective securing chain such that an adjacent link of the respective securing chain cannot be pulled through the respective chain engagement bracket, such than when the plurality of securing chains are positioned into the plurality of slots of the chain engagement brackets at all four corners of the cable operated boat lift respective to the plurality of attachment assemblies which the opposite end of the respective securing chains are attached, will restrain a motion of the lifting bunk structure in all horizontal directions.

2. A method of adjusting a slack of a plurality of securing chains of a lifting bunk restraint system for a lifting bunk structure of a cable operated boat lift, comprised of:

a plurality of securing chains comprised of a plurality of links, a plurality of attachment assemblies, each attachment assembly is comprised of:

a. an attachment plate having a slot that is wider than a diameter of a wire, but narrower than a width of a link of a chain that creates all links of one of the plurality of securing chains, and at least as long as the width of the link of one of the plurality of securing chains, that any of the links of one of the plurality of securing chains can be to be inserted into in order to create a connection between the attachment plate and the respective securing chain that such that an adjacent link of the respective securing chain cannot be pulled through the plate, to create a permanent connection that is positioned vertically and on a side of a horizontal lifting I-beam that is part of a lifting bunk structure of a cable operated boat lift b. a clamping plate that is positioned vertically and on an opposite side of the horizontal lifting I-beam that is part of the lifting bunk structure of the cable operated boat lift from the attachment plate c. a set of clamping hardware connecting the attachment plate to the clamping plate which can span a width of the horizontal lifting I-beam that is part of the lifting bunk structure of the cable operated boat lift and allows an attachment assembly position on the I-beam to be adjusted d. securing chain retaining hardware that provides retention of the respective securing chain in the slot of the attachment plate when the respective securing chain is not under load at least one of the plurality of attachment assemblies is attached to each corner of the lifting bunk structure of the cable operated boat lift, the lifting bunk structure which is comprised of:

a. a plurality of horizontal lifting I-beams b. a plurality of horizontal boat bunks that are arranged approximately perpendicular to the horizontal lifting I-beams c. a plurality of hardware and brackets that are used to connect the horizontal lifting I-beams to the horizontal boat bunks a plurality of chain engagement brackets that are permanently attached to vertical support pilings at all four corners of the cable operated boat lift and are respective to the plurality of attachment assemblies and securing chains, each of the plurality of chain engagement brackets which contains a slot that is wider than the diameter of the wire, but narrower than the width of the link of the chain that creates a plurality of all links of the plurality of securing chains, and at least as long as the width of the link of the plurality of securing chains, that any of the plurality of links of the securing chain can be to be inserted into in order to create a connection between the respective chain engagement bracket and the respective securing chain such that an adjacent link of the respective securing chain cannot be pulled through the respective chain engagement bracket, such than when the plurality of securing chains are positioned into the plurality of slots of the chain engagement brackets at all four corners of the cable operated boat lift respective to the plurality of attachment assemblies which the opposite end of the respective securing chains are attached, will restrain a motion of the lifting bunk structure in all horizontal directions, the method comprising adjusting a position of each of a plurality of attachment assemblies along the respective horizontal lifting I-beam such that the slack present in the securing chains when all the securing chains are positioned in a slot of one of a plurality of chain engagement brackets at each corner of a boat lift is less than one half a length of a link of one of the securing chains in order to limit horizontal motion of the lifting bunk structure, and which is done at initial installation of the plurality of attachment structures on the horizontal lifting I-beams and also done periodically to maintain the slack present in the system.

* * * * *